US008662151B2

(12) United States Patent
Gustafsson

(10) Patent No.: US 8,662,151 B2
(45) Date of Patent: Mar. 4, 2014

(54) HEAT EXCHANGER PLATE AND PLATE HEAT EXCHANGER WITH PORT HOLE HAVING CORRUGATION

(75) Inventor: Helen Gustafsson, Staffanstorp (SE)

(73) Assignee: Alfa Laval Corporate AB, Lund (SE)

( * ) Notice: Subject to any disclaimer, the term of this patent is extended or adjusted under 35 U.S.C. 154(b) by 1202 days.

(21) Appl. No.: 12/303,312

(22) PCT Filed: Apr. 30, 2007

(86) PCT No.: PCT/SE2007/050296
§ 371 (c)(1),
(2), (4) Date: Dec. 3, 2008

(87) PCT Pub. No.: WO2007/142590
PCT Pub. Date: Dec. 13, 2007

(65) Prior Publication Data

US 2009/0194267 A1 Aug. 6, 2009

(30) Foreign Application Priority Data

Jun. 5, 2006 (SE) ..... 0601244

(51) Int. Cl.
*F28F 3/08* (2006.01)

(52) U.S. Cl.
USPC ..... 165/167

(58) Field of Classification Search
USPC ..... 165/167
See application file for complete search history.

(56) References Cited

U.S. PATENT DOCUMENTS

| | | | | |
|---|---|---|---|---|
| 2,550,339 | A | 4/1951 | Ehrman | |
| 6,478,081 | B1 * | 11/2002 | Shaw | 165/167 |
| 2008/0196873 | A1 * | 8/2008 | Svensson | 165/167 |

FOREIGN PATENT DOCUMENTS

| | | |
|---|---|---|
| DE | 19917761 | 1/2001 |
| DE | 10211368 | 9/2002 |
| GB | 1035170 | 7/1966 |
| GB | 2107845 | 5/1983 |
| JP | 08-271180 | 10/1996 |
| RU | 2100733 C1 | 12/1997 |
| RU | 2110030 C1 | 4/1998 |
| WO | WO9325860 A1 | 12/1993 |

OTHER PUBLICATIONS

Decision on Grant of a Patent for Invention for Appln No. 2008152416 in English.
Int'l Search Report.
PCT Int'l Preliminary Report on Patentability (Form PCT/IB/373).

* cited by examiner

*Primary Examiner* — Brandon M Rosati
(74) *Attorney, Agent, or Firm* — Buchanan Ingersoll & Rooney PC

(57) ABSTRACT

The invention relates to a heat exchanger plate, and a plate heat exchanger including a plurality of heat exchanger plates. Each heat exchanger plate include a heat transfer area, an edge area, that extends around and outside the heat transfer area, and a number of portholes that extend through the heat exchanger plate and are located inside and in the proximity of the edge area. The porthole is defined by a porthole edge and has a center. The porthole edge has a first edge portion, that faces the edge area, and a second edge portion that faces the heat transfer area. The first edge portion has a corrugation seen from the center of the porthole. The second edge portion has a substantially plane shape seen from the center of the porthole.

18 Claims, 5 Drawing Sheets

HEAT EXCHANGER PLATE AND PLATE HEAT EXCHANGER WITH PORT HOLE HAVING CORRUGATION

THE BACKGROUND OF THE INVENTION AND PRIOR ART

The present invention refers to a heat exchanger plate according to the preamble of claim 1. The invention also refers to a plate heat exchanger according to the preamble of claim 10.

The invention refers to heat exchanger applications for relatively viscous media, which may contain particles, fibres or other difficult components. The invention may advantageously be used in for instance the following application fields: Destilleries, sugar mills, paper industry, textile industry, food industry, pharmaceutical industry etc. In large plate heat exchangers intended for relatively viscous media within said application fields, the size or the flow area of the portholes are of determining significance for avoiding large pressure drops. Relatively large inlet ports may be obtained in that the porthole edge is located close to the gasket groove. In the area between the gasket groove and the porthole edge, there is a corrugation which forms a wall towards the gasket groove and which ensures that the gasket is held in place in the gasket groove. If the size of the porthole is maximised, this corrugation will extend to the porthole edge so that this obtains a corrugated or wave-like shape seen from the centre of the porthole.

In the applications mentioned above, it is at the same time important to prevent the media, which may contain particles, fibres etc, from getting attached to the porthole edge. If the porthole edge is corrugated, the risk that particles or fibres will get attached increases.

If the porthole edge, in order to avoid this risk, is given an even shape, the problem of a decreasing flow area is instead arising since this even area has to extend inwards and towards the centre of the porthole from the above defined corrugation.

GB-A-2107845 discloses a heat exchanger plate for a plate heat exchanger. The heat exchanger plate comprises a heat transfer area, and edge area, which extends around and outside the heat transfer area, and a number of portholes, which extend through the heat exchanger plate and are located inside and in the proximity of the edge area. The portholes are defined by a porthole edge and have a centre. The porthole edge has a first edge portion, which faces the area, and a second edge portion, which faces the heat transfer area.

SUMMARY OF THE INVENTION

The object of the invention is to remedy or reduce the problems mentioned above. More specifically, the object is to provide a porthole having a as large flow area as possible and at the same time reducing the risk that particles or fibres of the media get attached to the porthole edge.

This object is achieved by the heat exchange plate initially defined, which is characterized in that the first edge portion has a corrugation seen from the centre of the porthole and that the second edge portion has a substantially plane shape seen from the centre of the porthole.

Thanks to this plane shape along the second edge portion, the risk that particles and fibres will get attached in the porthole is minimised and thanks to the corrugated first edge portion a sufficiently high strength along the outer edge of the heat exchanger plate is at the same time achieved. By providing the upper/outer edge of the porthole, i.e. the part of the porthole which faces outwardly towards the outer edge of the heat exchanger plate, with a corrugated shape and the lower/inner edge of the porthole, i.e. the part of the porthole which faces inwardly towards to the heat transfer area of the heat exchanger plate, with an even or plane edge, it is possible to make the porthole significantly larger and to reduce the risk that particles, fibres and the like will get attached to the porthole edge.

According to an embodiment of the invention, the corrugation forms a wave-like shape of the first edge portion. The wave-like shape may advantageously extend along the whole first edge portion. The second edge portion may advantageously have a plane or substantially plane shape along the whole second edge portion.

According to a further embodiment of the invention, said portholes are surrounded by a hole edge area adjoining the porthole edge and having a first area portion, which adjoins the first edge portion, and a second area portion, which adjoins the second edge portion, wherein the first area portion is corrugated through said corrugation. Advantageously, the second area portion may have a substantially plane extension in the proximity of the second edge portion and a corrugation which is located between the plane extension and the heat transfer area.

According to a further embodiment of the invention, said porthole is surrounded by a gasket groove which is designed for receiving a gasket and which is located outside the hole edge area seen from the centre of the porthole. By means of such gaskets it is possible to control which plate interspaces are to communicate with the port formed by the portholes. Advantageously, the gasket groove may be delimited to the porthole by the wall portions formed by the corrugation of the first area portion and the corrugation of the second area portion. Furthermore, the gasket groove may have a first distance to the porthole edge along the first edge portion and a second distance to the porthole edge along the second edge portion, wherein the first distance is shorter than the second distance. The shape and the extension of the gasket groove may thus be adapted in such a way that the shape and the size of the porthole is optimized.

According to a further embodiment of the invention, said corrugation comprises ridges and valleys which are provided in an alternating order and which extend in a direction towards the centre of the porthole.

The object is also achieved by the plate heat exchanger initially defined, which is characterized in that the first edge portion has a corrugation seen from the centre of the porthole and that the second edge portion has a substantially plane shape seen from the centre of the porthole.

BRIEF DESCRIPTION OF THE DRAWINGS

The invention is now to be explained more closely through a description of various embodiments and with reference to the drawings attached hereto.

DETAILED DESCRIPTION OF VARIOUS EMBODIMENTS OF THE INVENTION

Figure 1:
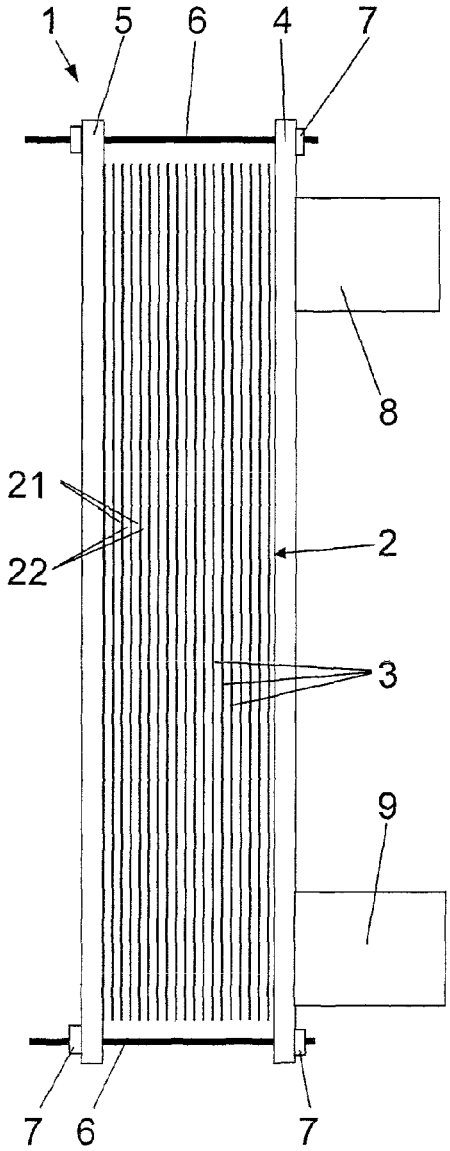
FIG. 1 discloses schematically a side view of a plate heat exchanger.
Figure 2:
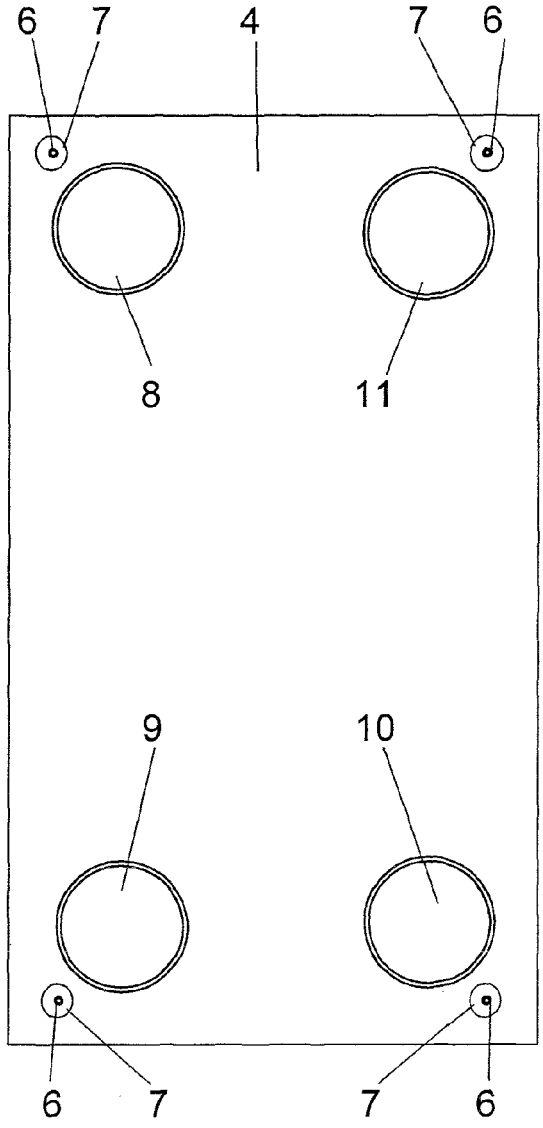
FIG. 2 discloses schematically a plan view of the plate heat exchanger in FIG. 1.

FIGS. 1 and 2 disclose a plate heat exchanger 1 comprising a plate package 2 having heat exchanger plates 3 which are provided beside each other. The plate package 2 is provided between two end plates 4 and 5 which may form a frame plate and a pressure plate, respectively. The end plates 4 and 5 are pressed against the plate package 2 and against each other by means of tie bolts 6 which extend through the end plates 4 and 5. The tie bolts 6 comprise threads and the plate package 2 may thus be compressed by screwing nuts 7 on the tie bolts 6 in a manner known per se. In the embodiment disclosed, four tie bolts 6 are indicated. It is to be noted that the number of tie bolts 6 may vary and be different in different applications.

The plate heat exchanger 1 comprises according to the embodiments described also a first inlet port 8 and a first outlet port 9 for a first medium, and a second inlet port 10 and a second outlet port 11 for a second medium. The inlet and outlet ports 8-11 extend in the embodiments disclosed through one of the end plates 4 and the plate package 2. The ports 8-11 may be arranged in many different ways and also through the second end plate 5.

Each heat exchanger plate 3 is manufactured in a compression-moulded metal sheet, for instance stainless steel, titanium or any other material which is suitable for the intended application. Each heat exchanger plate 3 comprises a heat transfer area 15 and an edge area 16, which extends around and outside the heat transfer area 15. The heat transfer area 15 is in the embodiment disclosed substantially centrally located on the heat exchanger plate 3, and in a known manner provided with a corrugation 17 of ridges and valleys. The corrugation 17 is obtained through compression-moulding of the metal sheet. In the embodiment disclosed, the corrugation 17 has merely been indicated schematically as extending obliquely over the heat transfer area 15. It is to be noted that the corrugation 17 also may comprise significantly more complicated extensions of the ridges and valleys, for instance along the fishbone pattern known per se. Also heat exchanger plates 3 having a substantially plane heat transfer area may be used within the scope of this invention.

Each heat exchanger plate 3 also comprises a number of portholes 18, in the embodiment disclosed four portholes 18, which extend through the heat exchanger plate 3 and are located inside and in the proximity of the edge area 16. Each porthole 18 is defined by a porthole edge 19, see FIG. 3, and has a centre. The portholes 18 are located in the proximity a respective corner of the heat exchanger plate 3 and are substantially concentric with the above mentioned inlet and outlet ports 8-11 of the plate heat exchanger 1.

Figure 6:
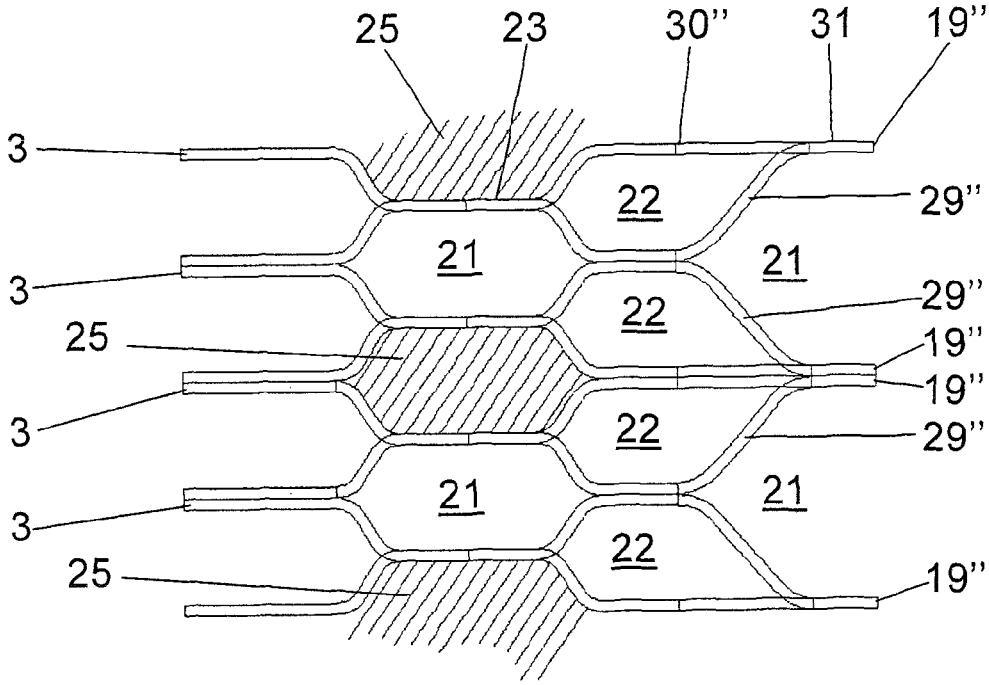
FIG. 6 discloses schematically a partly sectional perspective view of a port channel of the plate heat exchanger along the line VI-VI in FIG. 5.

The heat exchanger plates 3 are provided in such a manner in the plate package 2 that first plate interspaces 21, which communicate with the first inlet port 8 and the first outlet port 9, and second plate interspaces 22, which communicate with the second inlet port 10 and the second outlet port 11, are formed, see FIGS. 1 and 6. The first and second plate interspaces 21 and 22 are provided in an alternating order in the plate package 2.

Figure 3:
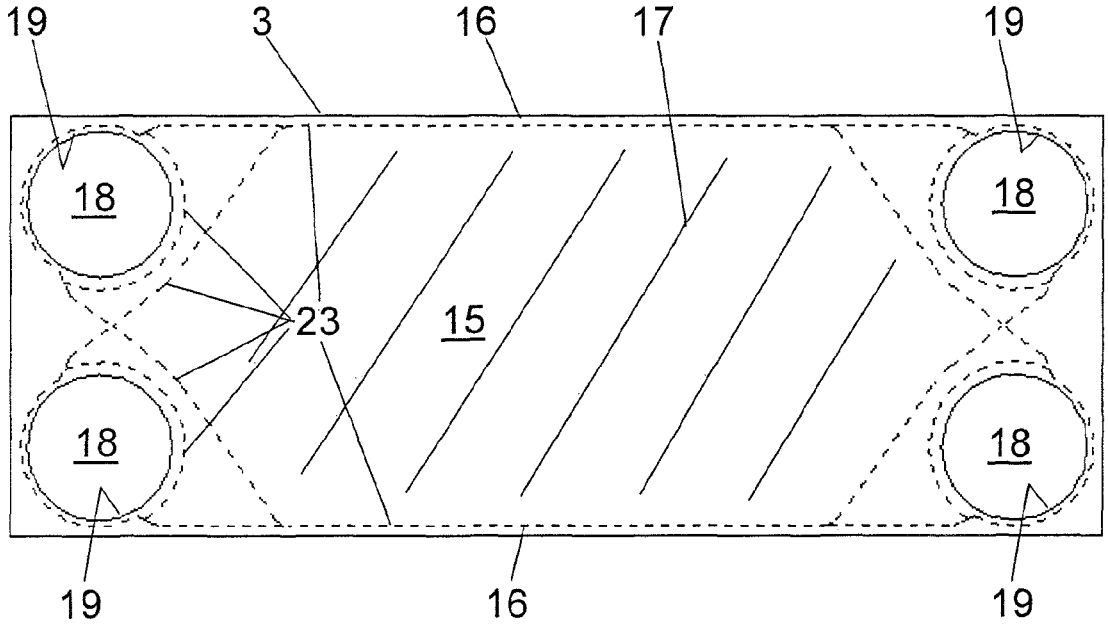
FIG. 3 discloses schematically a heat exchanger plate of the plate heat exchanger in FIG. 1.
Figure 4:
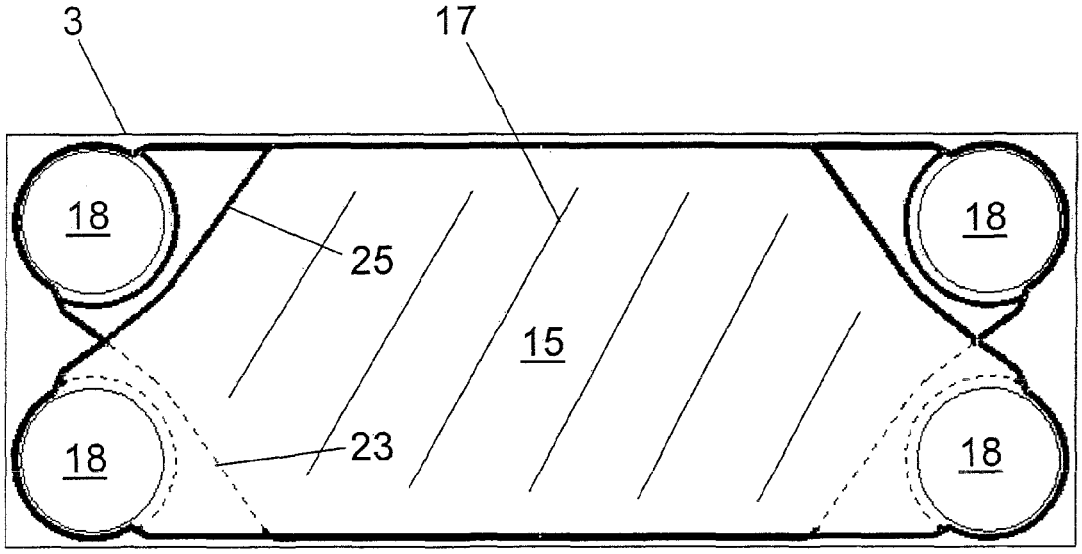
FIG. 4 discloses the heat exchanger plate in FIG. 3 with gaskets provided.

Such a separation of the plate interspaces 21, 22 may be achieved by means of one or several gaskets, which extend in the gasket grooves 23 which are formed during the compression-moulding of the heat exchanger plates 3. The gasket groove 23 of each heat exchanger plate 3 extends, as can be seen in FIG. 3, around the heat transfer area 15 and around each of the portholes 18. At each heat exchanger plate 3 a gasket 25 is, in the embodiments disclosed, provided before the mounting of the plate heat exchanger 1. The gasket 25 extends in a part of the gasket groove 23 in such a way that the gasket 25 encloses the heat transfer area 15 and two of the portholes 18 and also each of the two remaining portholes 18. The gasket 25 thus forms three separate areas which are delimited from each other by means of the gasket 25. It is to be noted that the gasket 25 does not necessarily need to be shaped as one single gasket but may also consist of several different gaskets.

During the mounting, every second heat exchanger plate 3 may be rotated 180°, for instance around a central normal axis or round a central longitudinal axis. Thereafter the heat exchanger plates 3 are compressed so that the desired first and second plate interspaces are obtained. In the plate package 2, the first medium may be introduced through the first inlet port 8, through the first plate interspaces 21 and out through the first outlet port 9. The second medium may be introduced through the second inlet port 10, through the second plate interspaces 22 and out through the second outlet port 11. The two media may for instance be conveyed in a counter current flow, as indicated in FIGS. 2 and 3, or in parallel flow in relation to each other.

Figure 5:
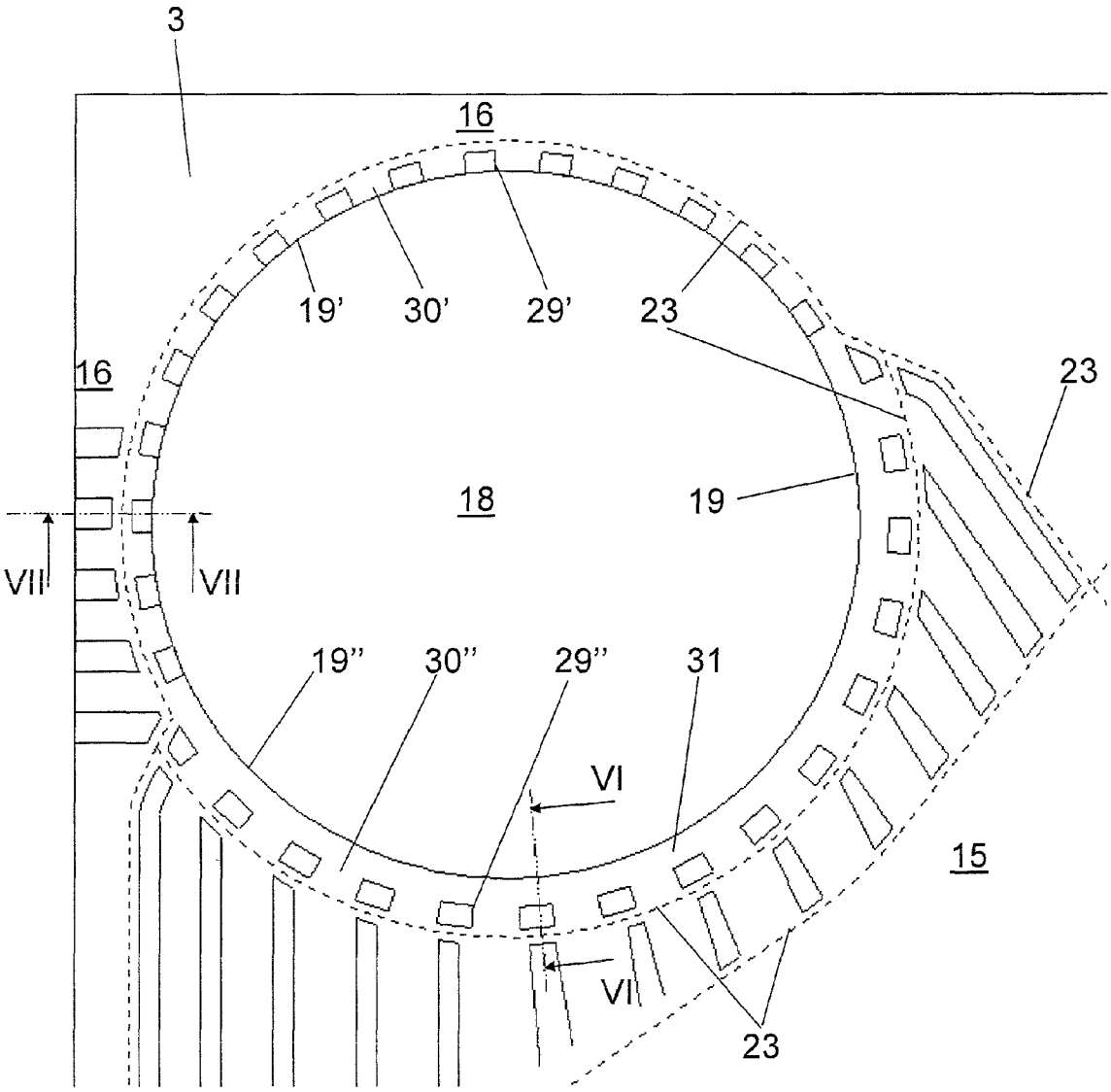
FIG. 5 discloses schematically a porthole of the heat exchanger plate in FIG. 3.
Figure 8:
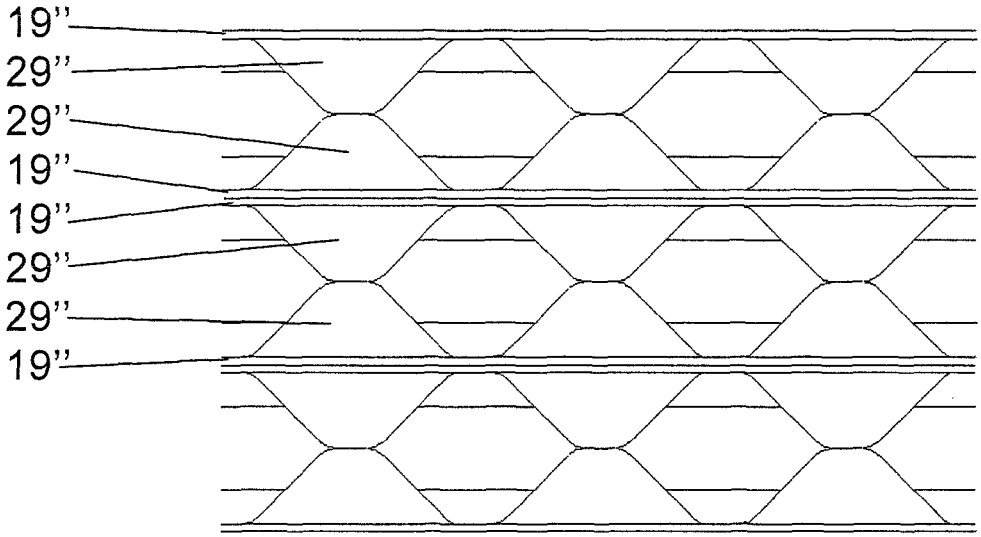
FIG. 8 discloses a view from the port channel towards a second edge portion of the heat exchanger plates.
Figure 9:
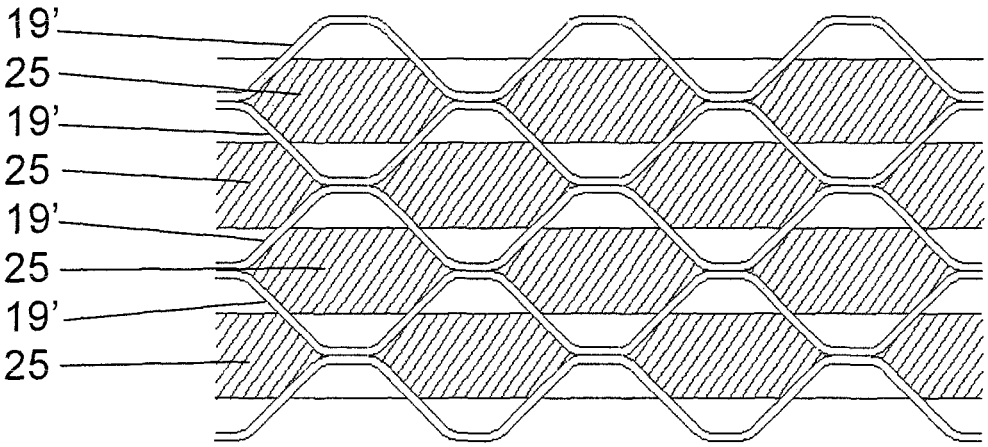
FIG. 9 discloses a view from the port channel towards a first edge portion of the heat exchanger plates.

The porthole edge 19 has, see FIGS. 3 and 5, a first edge portion 19', which faces outwardly from the heat transfer area 15 and towards the proximate area 16, and a second edge 19", which faces inwardly towards the heat transfer area 15 and from the proximate edge area 16. The first edge portion 19' has a corrugation 29' seen from the centre of the porthole 18, see FIG. 9. The second edge portion 19" has a plane or substantially plane shape seen from the centre of the porthole 18, see FIG. 8. The corrugation 29' forms a wave-like or substantially wave-like shape of the edge portion 19' seen from the centre of the porthole 18, see FIG. 9 whereas the plain shape of the second edge portion 19" forms a substantially straight line seen from the centre of the porthole 18. The corrugation 29' and the wave-like shape extend along the whole first edge portion 19'.

Each porthole 18 is surrounded by a hole edge area 13, which adjoins the port hole edge 19. The hole edge area 13 has a first area portion 30", which adjoins the first edge portion 19', and a second area portion 30", which adjoins the second edge portion 19". As can be seen in FIG. 5, the corrugation 29' of the first edge portion 19" extends outwardly from the centre of the porthole 18, and thus into the first area portion 30'. The first area portion 30' is thus corrugated through the above mentioned corrugation 29' of the edge portion 19'.

The second area portion 30" has a substantially plane extension 31 which adjoins the second edge port 19". The second area portion 30" also has a corrugation 29" which is located between the plane extension 31 and the heat transfer area 15, and more precisely between the plane extension 31 and the gasket groove 23. Both the corrugation 29' and the corrugation 29" comprise ridges and valleys which are provided in an alternating order and which extend in a direction towards the centre of the porthole 18, i.e. in a radial or substantially radial direction with respect to the centre of the porthole 18.

As indicated above, two of the portholes 18 are surrounded by a part of the gasket groove 23 which is designed for receiving a part of the gasket 25. These parts of the gasket groove 23 and the gasket 25 are located outside the hole edge area 30 seen from the centre of the porthole 18. The gasket groove 23 is here limited against the porthole 18 by wall portions formed by the corrugation 29' of the first area portion 30' and by the corrugation 29" of the second area portion 30". With respect to the two other portholes 18, which also are surrounded by the gasket groove 23 and the gasket 25, the gasket 25 extends merely to the part of the gasket groove 23 which adjoins the first area portion 30'.

The first area portion 30', which comprises merely the corrugation 29', is thinner than the second area portion 30" which comprises both the plane extension 31 and the corrugation 29". The gasket groove 23 thus has a first distance to the porthole 19 along the first edge portion 19' and a second distance to the porthole edge 19 along the second edge portion 19". The first distance is shorter than the second distance.

Figure 7:
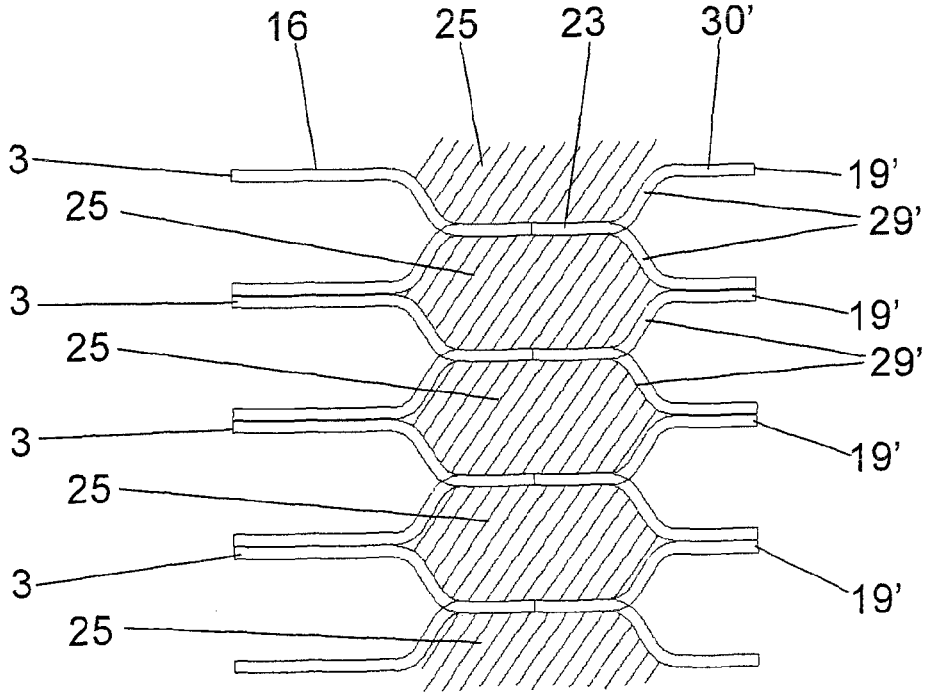
FIG. 7 discloses schematically a partly sectional perspective view of a port channel of the plate heat exchanger along the line VII-VII in FIG. 5.

The part of the gasket groove 23, which receives the corresponding part of the gasket 25 and which adjoins the first area portion 30', has a distance to the edge portion 19' which is equal to or substantially equal to the first distance. This means that the gaskets 25 in the different plate interspaces 21 and 22 will be located opposite to each other along the first area portion 30', see also FIG. 7.

The invention is not limited to the described embodiments but may be varied and modified within the scope of the following claims.

It is to be noted that the invention is applicable not only to plate heat exchangers having gaskets in all plate interspaces 21, 22, but also to permanently joined plate heat exchangers, for instance brazed or glued plate heat exchangers, and to plate heat exchangers having heat exchanger plates permanently joined in pairs, for instance pair of heat exchanger plates which are welded to each other.

In the embodiments described, the portholes 18 have a cylindrical or substantially circular shape. The portholes 18 may however also have any other suitable regular or irregular shape, for instance an oval shape or a polygonal shape, for instance a triangular, a square, a pentagonal etc. shape suitably with somewhat rounded corners.

What is claimed is:

1. A heat exchanger plate for plate heat exchangers comprising a heat transfer area, an edge area that extends around and outside the heat transfer area, and a number of portholes that extend through the heat exchanger plate and are located inside and in the proximity of the edge area, the porthole being defined by a porthole edge and having a center, the porthole edge having a first edge portion adjacent to the edge area, and a second edge portion adjacent to the heat transfer area, the second edge portion extending over a circumferential extent from one circumferential end of the second edge portion which is adjacent the heat transfer area to an other circumferential end of the second edge portion which is adjacent the heat transfer area, and wherein the first edge portion has a corrugation seen from the center of the porthole, and the second edge portion has a substantially plane shape seen from the center of the porthole, the substantially plane shape of the second edge portion extending continuously throughout the circumferential extent of the second edge portion.

2. A heat exchanger plate according to claim 1, wherein the corrugation forms a wave-like shape of the first edge portion.

3. A heat exchanger plate according to claim 2, wherein the wave-like shape extends along the whole first edge portion.

4. A heat exchanger plate according to claim 1, wherein the porthole is surrounded by a hole edge area, which adjoins the porthole edge and which has a first area portion which adjoins the first edge portion, and a second area portion which adjoins the second edge portion, wherein the first area portion is corrugated through said corrugation.

5. A heat exchanger plate according to claim 1, wherein the second area portion has a substantially plane extension, which adjoins the second edge portion and a corrugation, which is located between the plane extension and the heat transfer area.

6. A heat exchanger plate according to claim 4, wherein the porthole is surrounded by a gasket groove, which is designed for receiving a gasket and which is located outside the hole edge area seen from the center of the porthole.

7. A heat exchanger plate according to claim 6, wherein the gasket groove is delimited towards the porthole by wall portions which are formed by the corrugation of the first area portion and the corrugation of the second area portion.

8. A heat exchanger plate according to claim 6, wherein the gasket groove has a first distance to the porthole edge along the first edge portion and a second distance to the porthole edge along the second edge portion, wherein the first distance is shorter than the second distance.

9. A heat exchanger plate according to claim 1, wherein the corrugation comprises ridges and valleys which are provided in an alternating order and which extend in a direction towards the center of the porthole.

10. A plate heat exchanger having a number of heat exchanger plates each of which comprises a heat transfer area, an edge area, which extends around and outside the heat transfer area, and a number of portholes, which extend through the heat exchanger plate and are located inside and in the proximity of the edge area, the porthole being defined by a porthole edge and having a center, the porthole edge having a first edge portion adjacent to the edge area, and a second edge portion adjacent to the heat transfer area, the first edge portion extending circumferentially from one circumferential end of the first edge portion which is adjacent the edge area to an other circumferential end of the first edge portion which is adjacent the edge area, the second edge portion extending over a circumferential extent from the one circumferential end of the first edge portion to the other circumferential end of the first edge portion, and wherein the first edge portion has a corrugation seen from the center of the porthole, and the second edge portion has a substantially plane shape seen from the center of the porthole, the substantially plane shape of the second edge portion extending continuously throughout the circumferential extent of the second edge portion.

11. A plate heat exchanger according to claim 10, wherein the corrugation forms a wave-like shape of the first edge portion.

12. A plate heat exchanger according to claim 11, wherein the wave-like shape extends along the whole first edge portion.

13. A plate heat exchanger according to claim 10, wherein the porthole is surrounded by a hole edge area, which adjoins the porthole edge and which has a first area portion which adjoins the first edge portion, and a second area portion which adjoins the second edge portion, wherein the first area portion is corrugated through said corrugation.

14. A plate heat exchanger according to claim 13, wherein the second area portion has a substantially plane extension, which adjoins the second edge portion and a corrugation, which is located between the plane extension and the heat transfer area.

15. A plate heat exchanger according to claim 13, wherein the porthole is surrounded by a gasket groove, which is designed for receiving a gasket and which is located outside the hole edge area seen from the center of the porthole.

16. A plate heat exchanger according to claim 15, wherein the gasket groove is delimited towards the porthole by wall portions which are formed by the corrugation of the first area portion and the corrugation of the second area portion.

17. A plate heat exchanger according to claim 15, wherein the gasket groove has a first distance to the porthole edge along the first edge portion and a second distance to the porthole edge along the second edge portion, wherein the first distance is shorter than the second distance.

18. A plate heat exchanger according to claim 10, wherein the corrugation comprises ridges and valleys which are provided in an alternating order and which extend in a direction towards the center of the porthole.

* * * * *